US006120031A

United States Patent [19]

Adams

[11] Patent Number: 6,120,031

[45] **Date of Patent: *Sep. 19, 2000**

[54] GAME WITH RESERVABLE WILD INDICIA

[75] Inventor: William R. Adams, Las Vegas, Nev.

[73] Assignee: D. D. Stud, Inc., Las Vegas, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/838,178

[22] Filed: Apr. 16, 1997

Related U.S. Application Data

[63] Continuation of application No. 08/838,178, Apr. 16, 1997, which is a continuation of application No. 05/500,532, Jul. 11, 1995, abandoned, which is a continuation-in-part of application No. 08/311,781, Sep. 23, 1994, Pat. No. 5,431, 408.

[51] Int. Cl.[7] ..... A63F 1/00

[52] U.S. Cl. ..... 273/292; 273/293; 273/306

[58] Field of Search ..... 273/292, 293, 273/303, 304, 306

[56] References Cited

U.S. PATENT DOCUMENTS

| | | | |
|---|---|---|---|
| 1,738,902 | 12/1929 | Howard | 273/306 X |
| 2,639,922 | 5/1953 | Laycott | 273/306 |
| 2,687,306 | 8/1954 | Cheng | 273/306 X |
| 4,591,162 | 5/1986 | Fakhowry | 273/306 X |
| 4,846,480 | 7/1989 | Oliver | 273/292 |
| 4,915,393 | 4/1990 | Oliver | 273/292 |
| 5,282,633 | 2/1994 | Boylan et al. | 273/306 |
| 5,310,347 | 5/1994 | Brand | 273/306 X |
| 5,431,408 | 7/1995 | Adams . | |

FOREIGN PATENT DOCUMENTS

| | | | |
|---|---|---|---|
| 9305855 | 4/1993 | WIPO | 273/306 |

OTHER PUBLICATIONS

"Jackpots", *Hoyle's Modern Encyclopedia of Card Games*, Walter Gibson, 1974, p. 253.

"Draw Poker with Deuces Wild", *Hoyle's Simplified Guide to the Popular Card Games*, Walter Gibson, 1963, p. 124.

*Primary Examiner*—Sam Rimell
*Attorney, Agent, or Firm*—Galgano & Burke

[57] ABSTRACT

Games of skill or chance which provide a player, who has received a wild indicia during one game, with the opportunity to reserve that wild indicia for use in a subsequent game.

19 Claims, 4 Drawing Sheets

GAME WITH RESERVABLE WILD INDICIA

This is a continuation of application Ser. No. 08/838,178, filed Apr. 16, 1997, which is a continuation of application Ser. No. 08/500,532, filed Jul. 11, 1995, since abandoned, which is a continuation-in-part of application Ser. No. 08/311,781, filed Sep. 23, 1994, since issued as U.S. Pat. No. 5,431,408.

The present invention is directed to games and, more particularly, to novel games which provide a player with the opportunity to reserve a "wild" indicia from one play for use in a subsequent play.

BACKGROUND OF THE INVENTION

Games utilizing playing cards are popular throughout the world. Many people get hours of enjoyment and relaxation from playing cards. In certain parts of the world, wagering adds an additional dimension of excitement to the game. Whether in "card room" games where the players play against each other or in a traditional "casino" game environment where an employee of the house acts as a banker, wagering adds excitement to many forms of card games.

Players involved in card games with wagering often enjoy new games with relatively simple rules that can readily be learned by a beginner or casual player.

Typical card games involve a dealer providing a plurality of cards to each player. Each player then gathers the cards and tries to form the best possible hand according to some pre-determined hierarchy of hand values. For example, a standard poker hierarchy is, in descending order, Royal Flush, Straight Flush, Four of a Kind, Full House, Flush, Straight, Three of a Kind, Two Pair, One Pair, and High Card. In some games, players are permitted to discard certain cards and receive new cards in an effort to form a better hand.

It is also common to designate one or more cards as "wild" cards which can have any one of a predetermined number of values at the option of the player(s) receiving such wild cards. In this manner, the designation of wild cards within a deck can significantly increase the chances of a player attaining a particular hand. In known games which utilize wild cards, players must use the wild card in the hand in which the wild card is received. Therefore, if a player has a card hand of low or no value, the wild card may not be sufficient to allow that player to form a winning hand. For example, if the payout schedule for a given game starts at a pair of jacks, and the player has the following hand: 2, 4, 5, 10 of different suits and a wild card, the best poker hand that the player could form with one wild card would be a pair of 10's. This hand would not qualify for a winning payout.

It is therefore desirable to provide a card game which increases the players' excitement and enjoyment, as well as the level of player participation by providing a player with an opportunity to maximize the impact of receiving a wild card.

It is also desirable to provide wagering games other than cards with an exciting, new feature which comprises a wild indicia and novel methods of using that wild indicia.

It is also desirable to provide novel games readily adaptable to wagering which are relatively simple to learn for a new players.

It is also desirable to provide games which provide one or more players with opportunities to modify the player's winning payout by using such a wild indicia, received during one play, with a subsequent play.

SUMMARY OF THE INVENTION

The various embodiments of the present invention are directed to games which provide a player who has received at least one wild indicia during one play, with the opportunity to reserve that wild indicia for use in a subsequent play. The advantages of the present invention are applicable to a wide variety of games including "card" games, and other conventional games of chance or skill including keno, bingo, gaming devices, such as reel slots, dice games and lotto. As used herein, the term "card game", is intended to include conventional table/board type games wherein one or more persons deal actual playing cards to one or more players, as well as any types of mechanical or electronic devices which display indicia of playing cards.

The wild indicia of the present invention may take any forms desired by the players or the establishment conducting the game. For example, when playing a card game, the wild indicia will typically comprise al wild card. While jokers may be utilized to indicate a wild card, it is also within the scope of the present invention to use one or more other indicia such as one of the other cards of a deck or non-conventional indicia to indicate a wild card. Similarly, in games other than card games any form of wild indicia may be utilized. In all forms of the present invention, a player is provided with the possibility of utilizing a wild indicia when it is most advantageous for the player to do so, i.e. when the player will maximize a winning payout. When a player receives a wild indicia, the player can use that wild indicia immediately or may reserve the wild indicia for use in a subsequent play. For example, a player may use a wild card in a subsequent hand or may use a wild indicia received during the play of one game of bingo in a subsequent game.

One preferred embodiment of the present invention comprises a gaming device having an electronic touch-sensitive screen which is controlled, at least in part, by a player touching images on the screen.

Another embodiment of the present invention comprises a gaming device wherein input from a player is supplied to a device through actuation buttons.

A still further embodiment of the present invention comprises a game table designed for use by a dealer and a plurality of players. Along with conventional indicia on the game table including betting areas for each player, each player area is also provided with a reserve area wherein a player may place a wild card if that player decides not to use the wild card in the hand in which he receives the wild card and prefers to use the wild card in a later hand.

Each of the embodiments of the present invention provide one or more players with opportunities to maximize the beneficial effect of a wild indicia.

These and other embodiments are described in greater detail with reference to the drawings.

DETAILED DESCRIPTION

Figure 1:
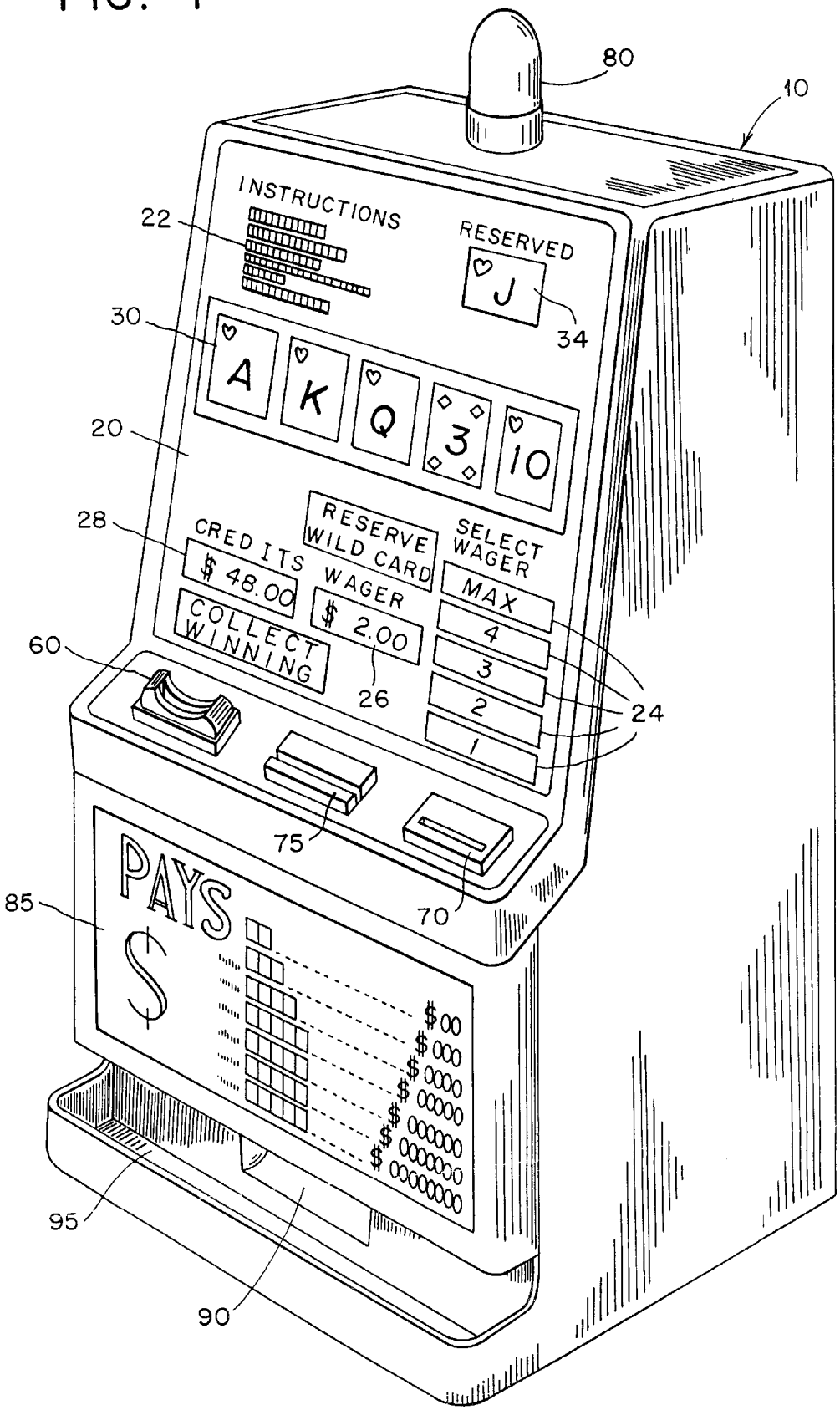
FIG. 1 illustrates a gaming device embodiment of the present invention comprising a touch screen.

The various embodiments of the present invention increase the level of player input, increase the likelihood of a winning payout, provide at least one player with the possibility to maximize the amount of a winning payout, and increase the overall level of enjoyment to a game which utilizes at least one wild indicia. The present invention achieves these desirable results by providing a player who receives a wild indicia during the play of one game with the option of reserving that wild indicia for use in a subsequent game.

While the various embodiments of the present invention are illustrated in conjunction with a game of five-card draw poker, the advantages of the present invention are equally applicable to a wide variety of other games of skill or chance.

According to the illustrated embodiments, five indicia of playing cards are displayed to a player. The player is provided with the opportunity to discard one or more of the cards and, if the player has received a wild card, to place that wild card in a reserve area for use with a later hand. To the extent that the player has discarded any cards or moved a wild card from his hand to a reserve area, the player is provided with replacement cards. Furthermore, a player may be provided with the option of reserving a wild card even if that player received the wild card as a draw card, i.e. as a replacement to one of the first indicia of playing cards displayed to that player. A winning payout is then provided to either the player with the highest hand or to any players which have attained a winning hand as determined by a predetermined payout schedule.

According to one preferred embodiment of the present invention, a first plurality of playing card indicia which are displayed to a player are selected from a collection which does not include a wild card. In this manner, the game can be controlled so that the first plurality of card indicia displayed to a player never contains a wild card. The cards remaining after making the first display can then be reshuffled along with one or more wild cards to form a second collection of cards from which additional cards are selected. The first plurality of playing card indicia may comprise a number of cards sufficient to form a complete hand or some lower number of cards. For example, the first three cards displayed to a player in a five-card poker hand may be selected from the first collection which does not include any wild cards while all remaining cards may be selected from collections to which at least one wild card indicia has been added. Similarly, wild card indicia may be placed in a first collection of cards from which the player's first card indicia are selected and then wild card indicia not displayed to one or more players as of a certain point in a hand may be removed so that no further wild cards are displayed. For example, in a five-card draw poker game, each player's first five cards may be selected from a first collection comprising one or more wild cards while draw cards may be selected from a second collection from which wild cards have been removed.

From the present description, those skilled in the art will appreciate that the odds of a player attaining a successful hand may be modified by modifying certain parameters of a game including the number of wild cards used, the number of indicia displayed from collections comprising one or more wild indicia, and the timing of when indicia are selected from collections comprising wild indicia. These and other parameters may be modified without departing from the scope of the present invention.

Further limitations can be placed upon one or more of the games of the present invention by limiting the number of plays for which a player may reserve a wild indicia. For example, in a game of bingo, a player may be provided with the opportunity of reserving a wild indicia for ten bingo games. In such instances, if the player does not use the reserved wild indicia within ten games after the wild indicia was displayed, the wild indicia would be forfeited. Similarly, in a card game, a player may be limited to utilizing a wild indicia in a certain number of hands following receipt of that wild indicia. By so limiting the use of a wild indicia, a player's chances of achieving a very high payout can be controlled. Those skilled in the art will also appreciate that the chances of displaying a wild indicia to a player can be controlled by controlling the total number of playing indicia in the collection from which cards are selected, by controlling the number of wild indicia added to the collection, as well as by keeping the wild indicia out of the collection until a predetermined number of indicia have been displayed.

FIG. 1 illustrates one embodiment of the present invention in the form of a gaming device 10 having a pressure-sensitive touch screen 20, a coin slot 60, a bill validator 70, a credit card receiver/terminal 75, flashing light 80, payout schedule 85, coin chute 90 and coin trough 95. This embodiment of the present invention can be activated by a player inserting an item of monetary value including coins, paper currency, tokens, or some form of credit indicator, such as a credit card. Suitable instructions are provided in instruction window 22 to guide a player through the initial steps necessary to start the game, as well as through subsequent steps. If a player has inserted more than the amount of the minimum wager, the player will be required to designate the amount of his wager by touching the corresponding wager area 24 under the designation "SELECT WAGER". The amount wagered will then be displayed in wager window 26. If the player had inserted an amount greater than the amount wagered, the player's remaining credits will appear in credit window 28. Wagers for subsequent hands can then be automatically drawn from the player's credits in a manner which is now well known in the art.

After a player has selected an amount for an initial wager, a plurality of indicia of playing cards 30 are displayed on the screen. Following instructions and prompts provided in instruction window 22, the player may opt to hold one or more of the cards by simply touching the image of the card on screen 20. An actuator may also be provided for this and other player input on a button panel. If the player receives a wild card, the player may also opt to reserve the wild card for use in a subsequent hand by touching the "RESERVE WILD CARD" area 32. When a player reserves a wild card, the player is preferably provided with an image of the wild card in reserve area 34. In this and other embodiments of the present invention, a player may or may not be permitted to utilize a wild indicia in the same hand or game in which the player designated that the wild indicia be reserved. Such rules are preferably set by the house or other rulemaker prior to play. Furthermore, as stated above, a player may receive a wild indicia either in an initial display or in a subsequent display, such as cards drawn after a discard.

If the player has discarded any cards and/or reserved a wild card, replacement cards are provided to the player's hand and displayed in display area 30. If the resulting display comprises one of a predetermined plurality of winning card hands, the player is provided with a winning payout. Particularly high winning payouts may be accompanied by discernable signals such as a flashing light 80 and audible sirens from a speaker (not shown). The amount that the player has won is then preferably added to the amount shown in the "CREDITS" window 28.

Figure 2:
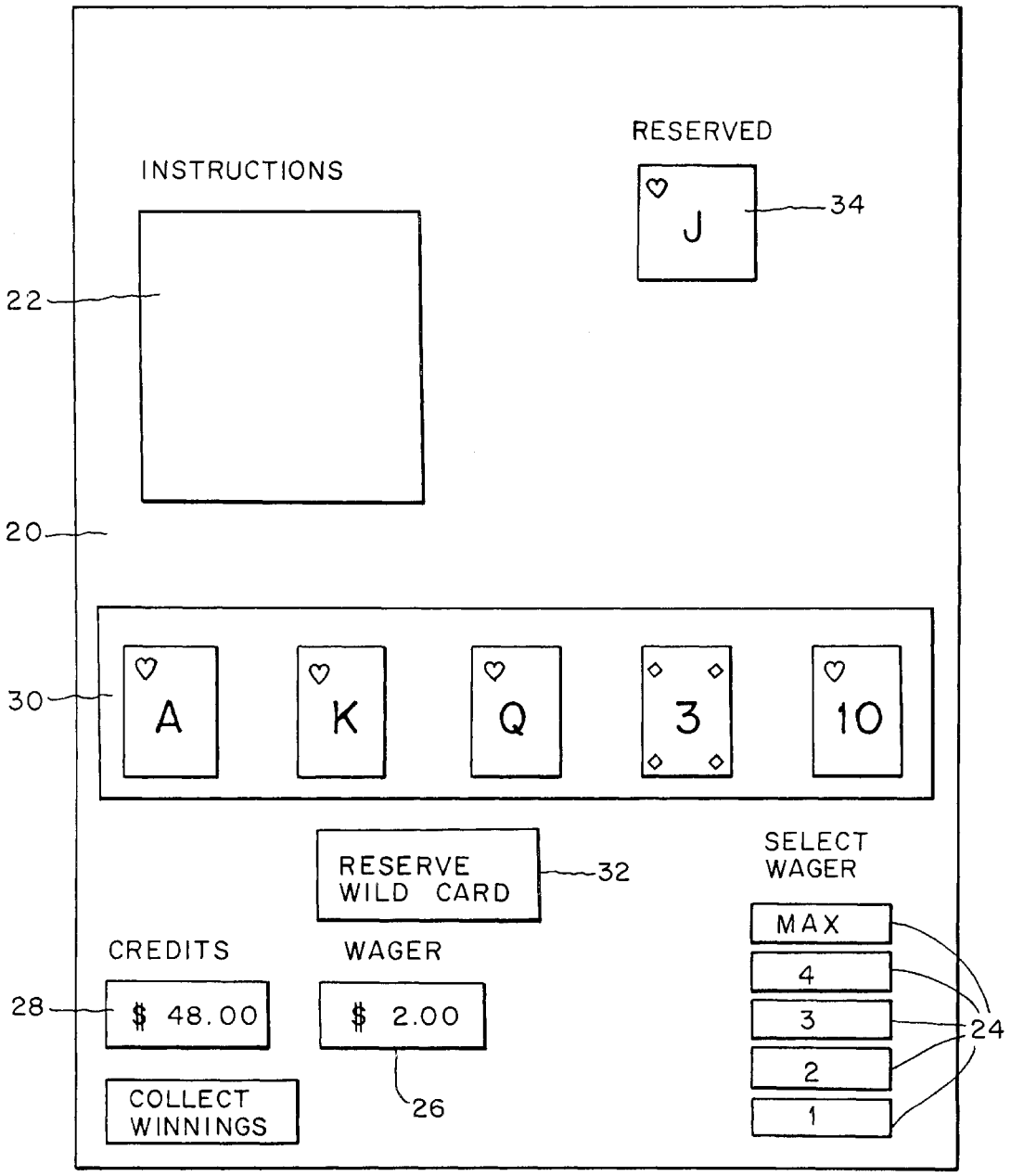
FIG. 2 illustrates a touch screen used with the embodiment of FIG. 1.

As an example, the hand shown in card display area 30 of FIG. 2 indicates a hand in which a player would want to utilize a wild card previously held in RESERVE area 34. Those familiar with poker will appreciate that by replacing the 3 of diamonds with the wild card, the player will have attained a Royal Flush and, typically, a large payout.

Since the present invention can be played with a wide variety of games, the winning payouts for a winning hand can vary widely. As an example, with the five-card draw poker game described above, the payout schedule could be as follows:

| SAMPLE TABLE PAYOUT SCHEDULE | |
|---|---|
| Royal Flush | 800 for 1 |
| Straight Flush | 50 for 1 |
| Four Of A Kind | 25 for 1 |
| Full House | 8 for 1 |
| Flush | 5 for 1 |
| Straight | 4 for 1 |
| Three Of AKind | 3 for 1 |
| Two Pair | 2 for 1 |
| Pair of Jacks or better | 1 for 1 |

Figure 3:
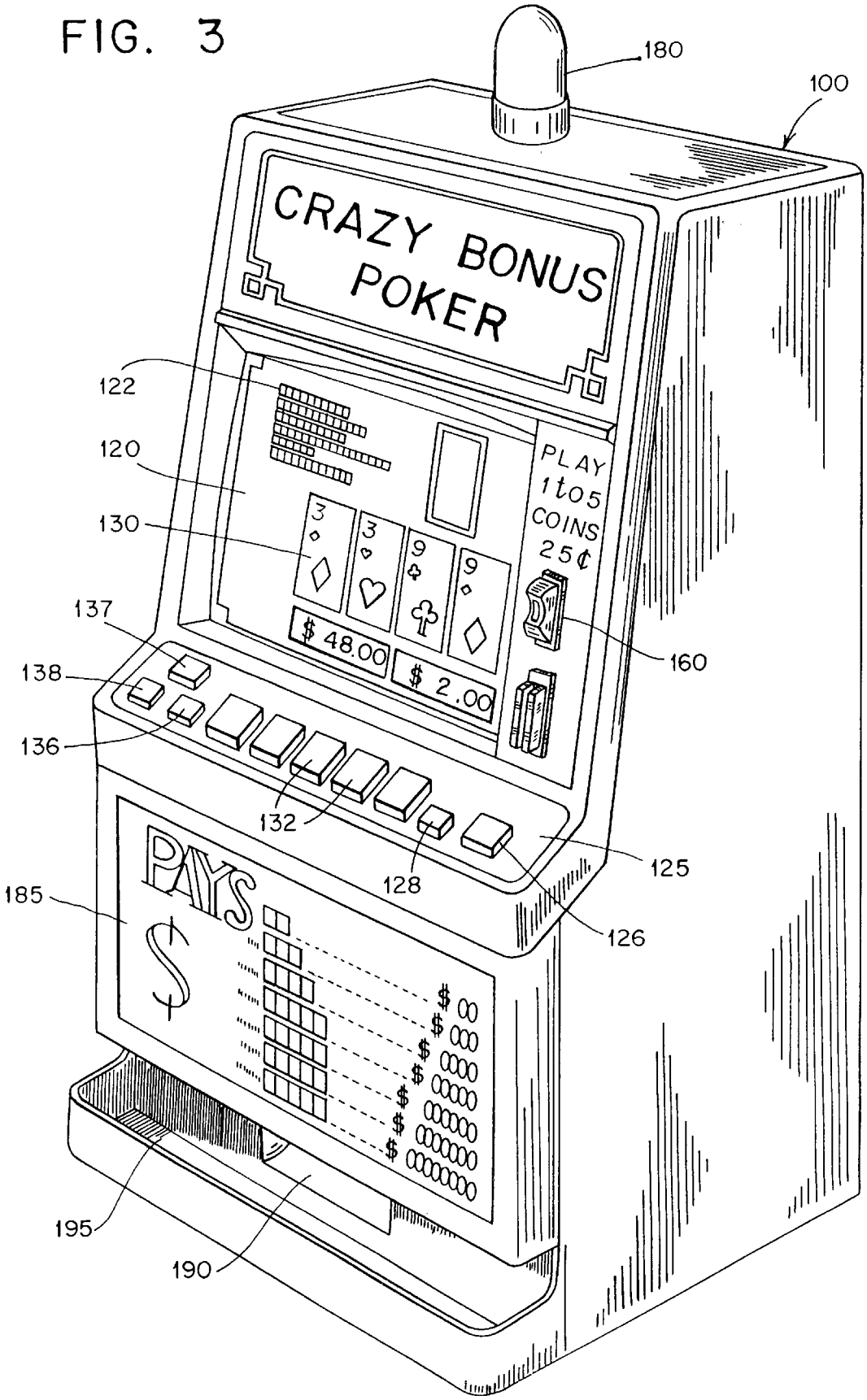
FIG. 3 illustrates a gaming device of another embodiment of the present invention.

An alternative embodiment of the present invention is illustrated in FIG. 3 in the form of a gaming device. This embodiment of the present invention differs from the embodiment illustrated in FIGS. 1 and 2 in that decisions are input to the machine by the player depressing one or more buttons on a button panel 125. Button panel 125 comprises a "DEAL/DRAW" button 126, "BET ONE" button 128, a "BET MAX" button 127, a plurality of "HOLD" buttons 132, a "RESERVE WILD CARD" button 133, a "CASH/CREDIT" button 136, a change button 137 and a "COLLECT WINNINGS" button 138. According to this embodiment of the present invention, after a player has input monetary value into coin slot 160 or bill validator 170, he can select the amount that he wants to wager on the present hand by depressing "BET ONE" button 128 the number of times needed to properly show his wager in the wager window on screen 120 or BET MAX button 127. The remaining portion of the player's credits will be indicated in credit window 129. The player then depresses "DEAL/DRAW" button 126 in order to receive a first plurality of cards. The player may then select which cards to hold by depressing corresponding "HOLD" buttons 132 which are most preferably aligned with the indicia of playing cards 130 appearing on screen 120. If the player has received a wild card that he wishes to reserve for use in a subsequent hand, the player then depresses "RESERVE" button 133 which will move the wild card up into wild card reserve area 134 on screen 120.

When the player has made his selection regarding which cards to hold and/or reserve, he must then again press "DEAL/DRAW" button 126 in order to receive replacement cards. According to this illustrated embodiment, after the player has received any necessary replacement cards the gaming device 100 automatically evaluates whether the player has received a winning hand and, if he has, provides a winning payout according to payout schedule 185 and increases the player's credits shown in credit window 129 accordingly. When a player has finished playing and wishes to withdraw any credits shown in credit window 129, the player can simply depress "COLLECT WINNINGS" button 138 in order to receive his money and/or credits. As illustrated, button panel 125 is also provided with "CHANGE" button 137 which will alert a casino attendant that a player requires change.

Figure 4:
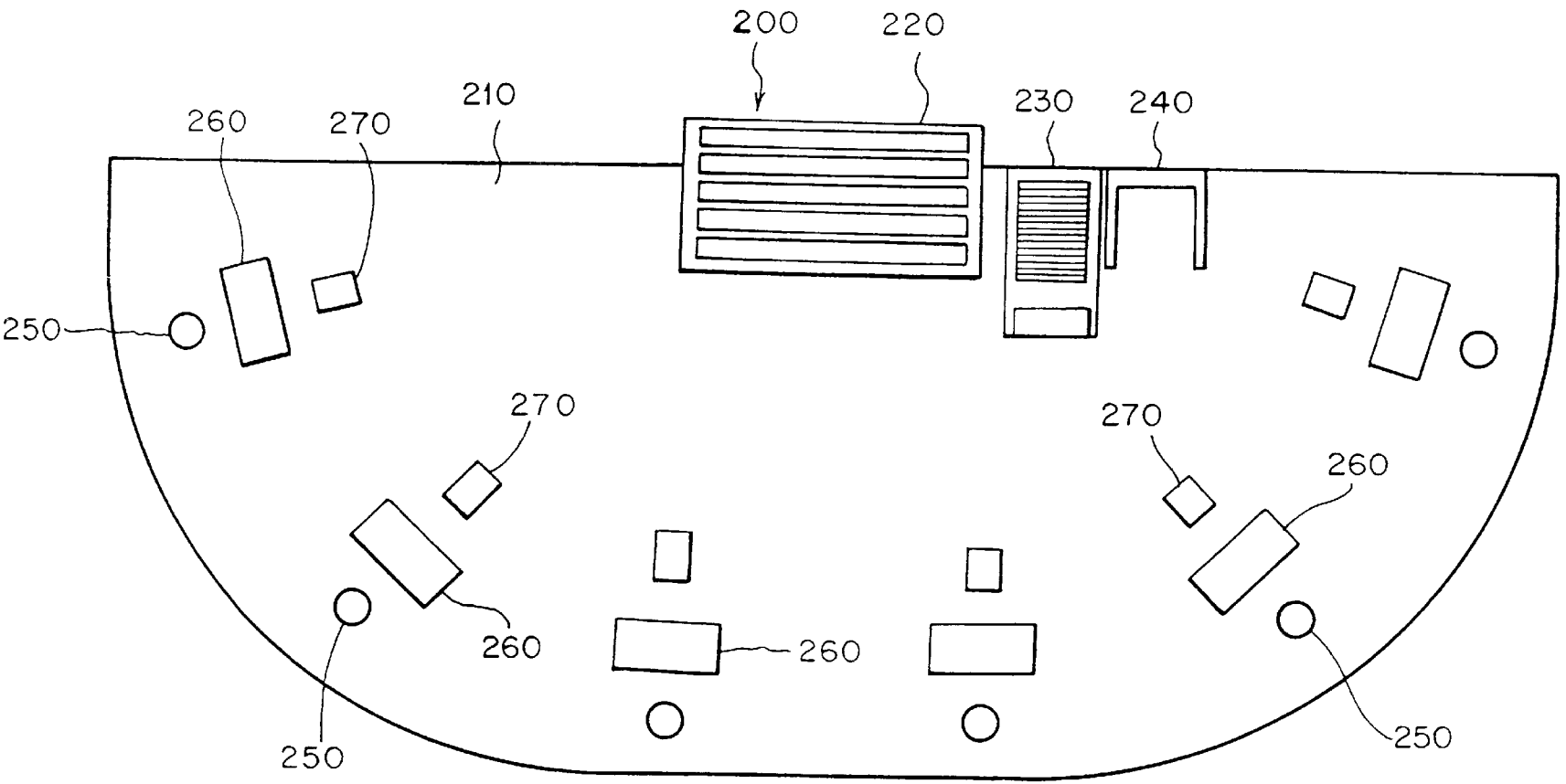
FIG. 4 illustrates a board game embodiment of the present invention.

Another embodiment of the present invention is illustrated in FIG. 4 wherein a gaming table 200 is provided with a playing surface 210, chip rack 220, card shoe 230 and discard tray 240. A plurality of player stations are located around the playing surface. According to this embodiment of the present invention, each playing area comprises a wager area 250, a card area 260 and a wild card reserve area 270. According to this embodiment of the present invention, when a player wishes to reserve a wild card for subsequent use, the reserved wild card is placed in a "wild card reserve area" 270.

While the present embodiments have been described as providing a player with an option of reserving a wild card when that player receives such a wild card during the initial deal, the various embodiments of the present invention can also provide a player with the option of reserving a wild card for use in a subsequent hand even if that player receives one or more wild cards as replacement cards for those which he had originally discarded or reserved. Furthermore, a player may be provided with the option of retrieving a wild indicia from a wild indicia reserve area for use in the same game that the wild indicia was received, either between or after the player has received or seen additional playing indicia.

As a further enhancement to the excitement provided by the games of the present invention, it is also within the scope of the present invention to provide a higher or lower payout when the player uses a wild indicia.

The present invention is readily adapted for use with a wide variety of wagering games of chance or skill including blackjack, other forms of poker, keno, bingo, lotto, as well as with video slots and/or a reel slot. For example, other card games such as blackjack may be similarly played wherein one or more wild card indicia are displayed to players either in a physical form, such as in a table version, or as an image on a screen in a video version.

Those skilled in the art will appreciate that the present invention can be modified for use in other games with or without additional restrictions. For example, in a bingo game, a wild indicia received during one game may be utilized in subsequent games to cover whatever spot that a player chooses. In a lotto game, a player might utilize a wild indicia for use as any number in a subsequent play. Still further embodiments may comprise placing a wild indicia on one or more faces of a die for use in a dice game. Therefore, it is within the scope of the present invention to utilize the traveling wild indicia of the present invention in games of craps. In a keno game, a keno game could be limited to permit a player to use a reserved wild indicia in subsequent plays only if the player was using an identical wager in an identically played game. The use of the wild indicia may be restricted to a predetermined number of hands following the receipt of the wild indicia by the player. These and other restrictions may or may not be imposed on other wagering games of chance or skill.

According to further embodiments of the present invention, a wild indicia may have limitations. For example, the wild indicia may be completely wild in that it can be used as a substitute to any indicia in the game. Alternatively, the wild indicia may be restricted so that it can only be played as certain other symbols.

Furthermore, according to a further embodiment of the present invention, the mere receipt of a wild indicia can provide a player with one or more winning advantages. For example, a wild indicia may act as a multiplier in order to modify the payout schedule. Alternatively, the receipt of a wild indicia may provide or qualify the player for a super jackpot. Still furthermore, a player may be provided with an opportunity to increase the amount of a payout by some percentage e.g. 25% or even by a multiplier of two or three. Still furthermore, the wild indicia could also provide opportunities for a player to qualify for other opportunities. For example, in a card game if a wild card was utilized to form a royal flush, that winning player could be entered into a super-jackpot prize drawing. Those skilled in the art will appreciate that these embodiments may be achieved without departing from the scope of the present invention.

What is claimed is:

1. A method of conducting a series of games of chance comprising the steps of:

providing means for displaying a plurality of randomly selected indicia;

designating at least one of said randomly selected indicia as a travelling wild indicia; and maintaining said travelling wild indicia for use in a subsequent game by a player of said game.

2. A method of conducting a series of games of chance according to claim 1 wherein said step of providing displaying means comprises providing a reel slot machine.

3. A method of conducting a series of games of chance according to claim 1 wherein said step of providing displaying means comprises providing a video display which displays indicia for at least one game selected from the group consisting of poker, blackjack, keno, reel slots, video slots, dice, bingo and lotto.

4. A method of conducting a series of games of chance according to claim 1 wherein a player is provided with the option of only using a reserved travelling wild indicia in one of a predetermined number of subsequent games.

5. A method of conducting a series of games of chance according to claim 1 wherein said step of providing displaying means comprises providing a card table with a plurality of playing cards.

6. A method of conducting a series of games of chance according to claim 1 wherein said step of providing displaying means comprises providing a video screen with indicia of playing cards.

7. A method of conducting a series of games of chance according to claim 6 wherein a player receives a replacement card if a travelling wild card was reserved for subsequent use.

8. A method of conducting a series of games of chance according to claim 7 further comprising the step of requiring said player to decide whether the player will use the travelling wild indicia in a given hand before receiving replacement cards in that hand.

9. A method of conducting a series of games of chance according to claim 1, further comprising the step of displaying at least one indicia of playing indicia to at least one player which indicia is randomly selected from a first collection of playing indicia.

10. A method of conducting a series of games of chance according to claim 9 wherein said first collection comprises at least one travelling wild indicia.

11. A method of conducting a series of games of chance according to claim 9 wherein said first collection does not contain a wild indicia.

12. A method of conducting a series of games of chance according to claim 11 further comprising at least one subsequent collection and wherein said subsequent collection comprises the step of providing at least one travelling wild indicia.

13. A method of conducting a series of games of chance according to claim 9, further comprising the step of, during play of said game, providing said at least one player with the option of reserving said traveling wild indicia for use in a subsequent game if said at least one player has been displayed a traveling wild indicia.

14. A method of conducting a series of games of chance according to claim 1 wherein said randomly selected indicia are selected utilizing at least some input from a player.

15. A method of conducting a series of games of chance according to claim 12 wherein said player input comprises rolling at least one die.

16. A method of conducting a series of games of chance according to claim 14 wherein said player input comprises said player selecting at least one indicia before said player is informed of winning indicia.

17. A method of conducting a game of chance according to claim 1 wherein a player receives a replacement indicia if a travelling wild indicia was reserved for subsequent use.

18. A method of conducting a series of games of chance according to claim 1 further comprising the step of requiring said player to decide whether the player will use the travelling wild indicia before receiving replacement indicia.

19. A method of conducting a series of games of chance according to claim 1 further comprising the step of providing at least one player with an opportunity to place at least one wager.

* * * * *